United States Patent [19]

Knickerbocker

[11] Patent Number: 4,868,019

[45] Date of Patent: Sep. 19, 1989

[54] CAMOUFLAGE SYSTEM AND MATERIAL

[76] Inventor: Harry W. Knickerbocker, 15199 S. Maplelane Rd., Oregon City, Oreg. 97045

[21] Appl. No.: 189,421

[22] Filed: May 2, 1988

[51] Int. Cl.[4] ..... F41H 3/00

[52] U.S. Cl. ..... 428/17; 2/1; 156/61; 428/21; 428/919

[58] Field of Search ..... 2/1; 428/17, 919, 21; 156/61

[56] References Cited

U.S. PATENT DOCUMENTS

| | | | |
|---|---|---|---|
| 1,139,642 | 5/1915 | Cox | 428/919 X |
| 1,291,809 | 1/1919 | Ekker | 428/919 X |
| 2,686,308 | 8/1954 | Courtois | 2/1 |
| 3,047,875 | 8/1962 | Patterson, Jr. | 2/1 |
| 3,690,671 | 9/1972 | Slutsky | 428/919 X |
| 4,375,488 | 3/1983 | Hogan | 428/17 |
| 4,576,904 | 3/1986 | Anitole | 430/347 |
| 4,656,065 | 4/1987 | Yacovella | 428/17 |

OTHER PUBLICATIONS

"Take a Tip from Gander Mountain", a page from the 1966 Gander Mountain Catalogue.

Brochure, "The Animals Can Still See You" (2 pages), Knickerbocker Enterprises, Oregon City, OR, (undated).

*Primary Examiner*—Henry F. Epstein

*Attorney, Agent, or Firm*—Klarquist, Sparkman, Campbell, Leigh, & Whinston

[57] ABSTRACT

The present invention is an improved camouflage system for visually concealing people and objects from animals wherein the selection of colors to be used depends on the extent of the animal's color vision and the reflectivity of the colors used in a neutral value scale. In one form of the invention, the system includes a base color carrier means of a base color hue having a first reflectivity and adapted for application to people or objects. The system further includes at least three contrast color carrier means of different contrast color hues adapted for application to people or objects, wherein the contrast color hues each have a reflectivity which is substantially different from the reflectivity of the base color hue and the other contrast color hues. In one embodiment of the invention, at least one of the base color hue and the contrast color hues is other than brown, black and white. In another embodiment of the invention, at least one of the base color hue or the contrast color hues is a hue which is highly visible to humans but not as perceptible to the animal.

21 Claims, 2 Drawing Sheets

CAMOUFLAGE SYSTEM AND MATERIAL

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

The present invention relates to a system and material for camouflaging people from animals, and in particular, for increasing the visibility of a hunter to other hunters while making the hunter less perceivable to a hunted animal.

2. Description of the Prior Art

For centuries, hunters have used various means of camouflaging themselves from animals which were being hunted. In addition, the military uses camouflage to make people and machinery less perceivable to an enemy. In general, the primary goal of camouflage is to make the person or object blend into the environment.

The military and other camouflage patterns and systems currently being used use a variety of different colors which generally match colors found in the environment in which the object or person to be camouflaged is located. These colors are typically various subdued shades of green, brown and black. While this system works well for humans, a different system is needed for other animals which lack color vision. Many animals have only rod cells in their eyes. The rod cells measure the amplitude, or brightness, of the color, not the color itself. Therefore, many animals perceive things as various shades of gray.

Although camouflage systems are known to use multiple colors, typically these colors appear to a colorblind animal as only two different grays. Therefore, someone wearing such a system is more readily distinguished from the environment as the effectiveness of the camouflage is greatly decreased.

Another problem with camouflage systems is that most of the systems utilize shades of green, brown and black, which tend to blend into the background when perceived by humans. Therefore, the hunter is not visible to other hunters and is in danger of being shot by other hunters.

Therefore a need exists for an improved camouflage system directed toward overcoming these and other disadvantages of the prior art.

SUMMARY OF THE INVENTION

The present invention is an improved camouflage system for visually concealing people and objects from animals. Since some animals are colorblind, the system is based in part on the neutral value scale, in which a color is evaluated based on it reflectivity, rather than its associated hue.

In one form of the invention, the system includes a base color carrier means, such as sheet material, cosmetics or paint, adapted for application to people or objects. The base color carrier means is of a base color hue having a first reflectivity. This form of the system further includes at least three contrast color carrier means, such as sheet material, cosmetics or paint adapted for application to people or objects. The contrast color carrier means are each of a contrast color hue having a reflectivity which is substantially different from the reflectivity of the base color hue and the other contrast color hues.

In a specific embodiment of the invention, at least one of the base color hue and the contrast color hues is other than brown, black and white.

In another embodiment of the invention, at least one of the base color hue and the contrast color hues is selected to be a hue which is highly visible to humans, but not as perceptible to the animal being hunted. For example, hues of blue are not highly perceptible to some birds, but can be readily seen by hunters. In this manner, a person or object being camouflaged using such hues is highly visible to other hunters.

It is therefore an object of the present invention to provide a camouflage system and material which makes the hunters less visible to the animals being hunted.

It is a further object of the present invention to make the hunters more visible to other hunters, so that the safety of the hunters is increased.

These and other objects, features and advantages will become apparent with reference to the following description and drawings.

DETAILED DESCRIPTION

Figure 1:
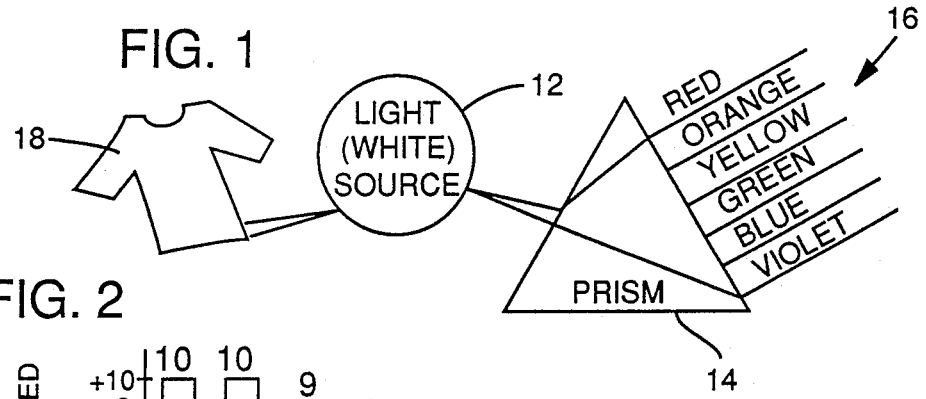
FIG. 1 shows a light source passing through a prism to an object for purposes of explanation.

As illustrated in FIG. 1, when whit light, or sunlight, is passed from a source 12 through a prism 14, it is broken up into a band of colors called the visible light spectrum 16. The visible light spectrum 16 contains the color hues of red, orange, yellow, green, blue and violet. All of the colors of the spectrum are generally visible to humans, but most animals either do not perceive color, or have slight color perception for some, but not all, colors. Also, many game birds perceive some colors better than others. For example, turkeys have full color vision, but are less able to discern blue colors while most ducks detect yellow and red colors to a greater extent than green colors.

Generally, the eye of a vertebrate may contain rod cells for black, white and gray vision and/or cone cells for color vision. There are three basic visual systems which are present in vertebrates. First, there are animals with all rod cell vision which can only see objects as neutral colors, i.e., black, white and gray. Second, there are animals with all cone cell vision which are believed to be able to distinguish individual colors to some extent if the colors are separated, but not if the colors are adjacent to each other, such as in camouflage systems. Third, there are animals, such as man, with both rod and cone cell vision.

Color vision in vertebrates is made possible by the presence of three light sensitive pigments in three different kinds of cone cells. The cone cells each contain a different light sensitive pigment, and if an animal is missing a particular light sensitive pigment, the animal cannot see that specific color. Most animals other than humans lack at least one of these light sensitive pigments.

In low light conditions, such as early morning, late evening and nighttime, even humans and other creatures with full color vision become effectively colorblind due to insufficient light to stimulate cone cell vision.

Figure 2:
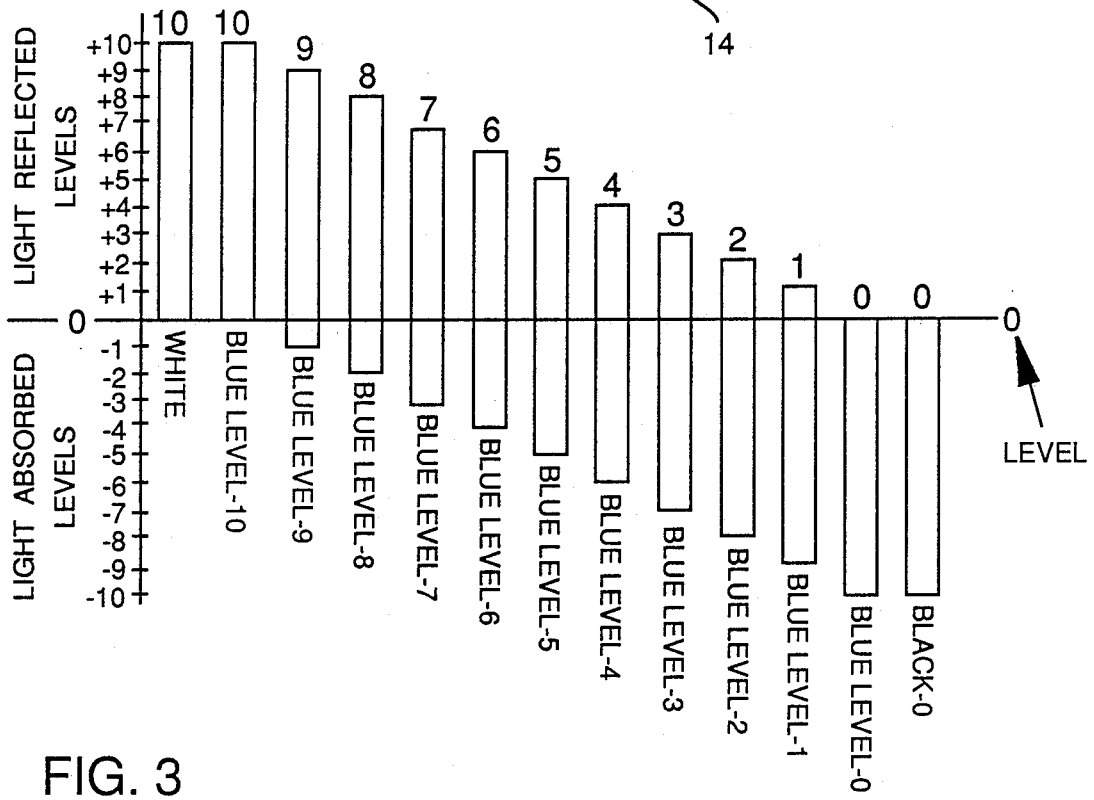
FIG. 2 shows the color blue at its varying reflectance values relative to a neutral value scale.

Animals without color vision (or under low light conditions) tend to see all objects as neutral colors. The neutral colors are white, gray and black, which lack hue and differ from one another only in brightness, or the degree of lightness and darkness. Brightness is measured by determining the reflectance of a surface. The reflectance is affected not only by absorption by the surface, but also by the intensity of the illuminating light. A surface is said to be white if it reflects about eighty percent of the visible light of any wavelength that falls on it, and black if it reflects only about five percent. Various shades of gray are between these extremes. The reflectance of all colors and various mixtures of colors can be measured by the level of light reflected and/or absorbed by the surface of an object or person using a reflectometer. FIG. 2 illustrates the various levels of light absorption and reflection for hues of blue ranging on a neutral value scale, explained below, from 0 (highest absorption) to 10 (highest reflectance).

As shown in FIG. 1, when white light from the light source 12 shines on a shirt or other object 18 having a reflectance at level 0, all of the light is absorbed and the shirt appears black to both humans and animals. As apparent from FIG. 2, black and blue level 0 each have a reflectance value of 0. When white light from the light source 12 shines on a shirt 18 having a reflectance at level 10, all of the light is reflected, and the shirt appears as white to humans and animals. As shown in FIG. 2, in this case, white and blue level 10 each have a reflectance value of +10. All of the color hues have reflectant values which can be divided between level 0 black and level +10 white. Thus, as illustrated in FIG. 2, the color blue is shown at each of its reflectant values from level 0 (very dark blue) to +10 (very light blue). Generally, any color can be adjusted to reflect at any level desired.

Figure 3:
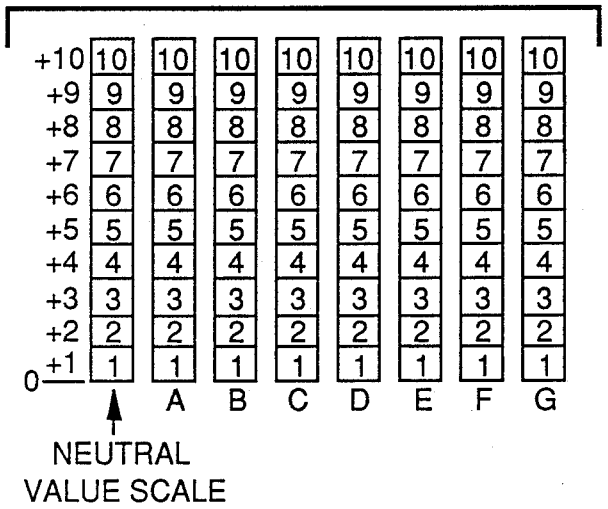
FIG. 3 shows the relationship between the various colors of the visible light spectrum and the neutral value scale.

The neutral value scale shown in FIG. 3 shows black as a reflectant level 0 and white as a reflectant level +10. The neutral value scale numbers 1 through 9 represent different values of the mixes of black and white (gray) that are equidistant from 1 to 9, with the darkest gray at level 1 and the lightest gray at level 9. Columns A, B, C, D, E, and F in FIG. 3 illustrate the relationship of the various colors of the white light spectrum to the neutral value scale. Column A represents red, column B represents orange, column C represents yellow, column D represents green, column E represents blue, column F represents violet and column G represents any other mix of colors.

While humans with normal color vision see all of the colors in the visible light spectrum or their mixes at any level of light reflectance, colorblind animals generally see colors as various levels of gray in the neutral value scale. While a human can see a red hue with the reflectant value level of 6 as a level 6 red, most animals would see that color only in the neutral value scale as a level 6 gray. The same is true of all colors at any level. Since colorblind animals only perceive these colors in their neutral value scale, colors which are readily perceivable to humans and are significantly different from the colors typically occurring in the environment may be utilized in a camouflage system. Bright colors, such as fluorescent colors which are seen by most animals as white, and uncommon or non-naturally occurring colors such as yellow, orange, purple, etc., can be utilized to make hunters more visible to each other. At the same time, if the colors are applied to a carrier, such as fabric or other sheet material, or included in paint or cosmetics, at various reflectance levels, they provide a camouflage system that camouflages humans from animals, but allows the humans to be easily seen by other humans. Also, colors can be selected to avoid those detected by animals with partial color vision.

Figure 4:
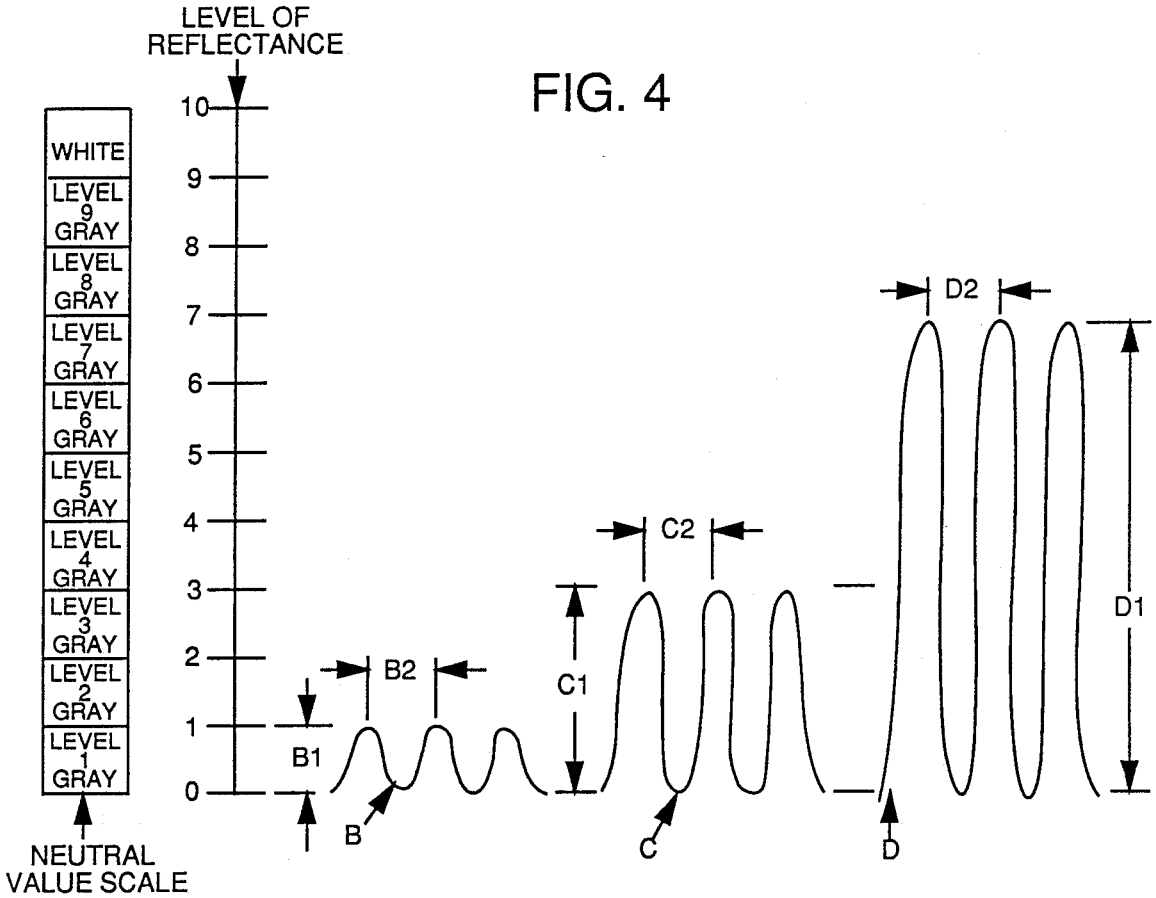
FIG. 4 is a graph illustrating light reflectance and frequency in relation to levels of reflectance in the neutral value scale.
Figure 5:
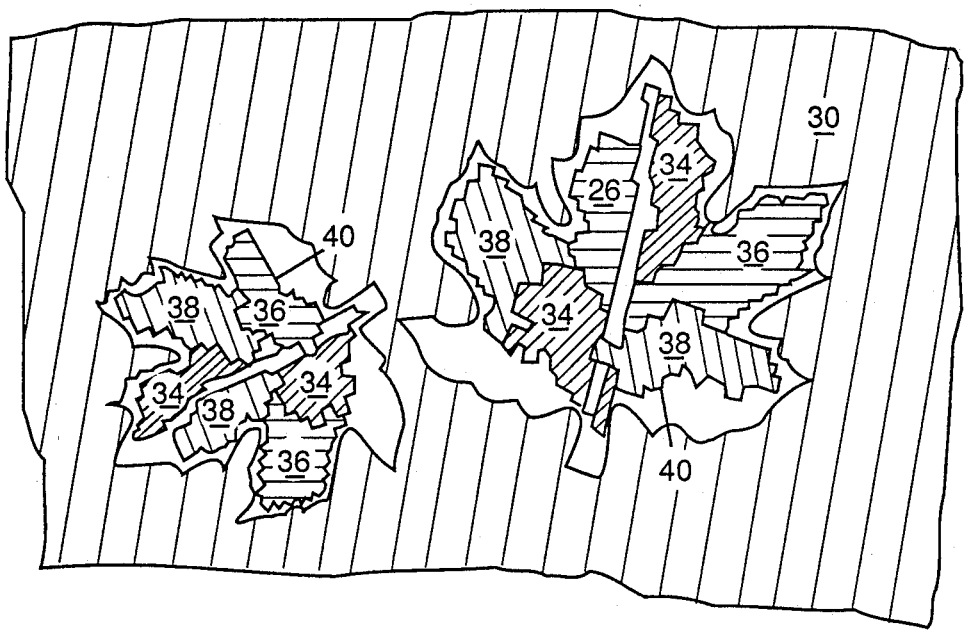
FIG. 5 is an example of camouflage fabric in accordance with the system of the present invention.

FIG. 4 is a graph illustrating light reflectance and frequency in relation to the level of reflection in the neutral value scale. All colors, regardless of their wavelength, can be represented on the chart according to the amplitude, or brightness, of the color. The lower the amplitude of the color, the darker the level is in the neutral value system, down to black or 0 amplitude. The higher the amplitude, the lighter or brighter the color up through various shades of gray to white on the neutral value scale.

In FIG. 4, waveform B represents a color with an amplitude (B1) reflecting to the top of level 1, waveform C represents a color with an amplitude (C1) reflecting to the top of level 3, and waveform D represents a color with an amplitude (D1) measuring to the top of level 7. Regardless of the wavelength represented by the light, the amplitude will not change as long as the color brightness does not change. In FIG. 3, all of the wavelengths (B2, C2 and D2) are equal, which means that the color hues are all the same, except that the hue has three different levels of brightness as determined by their amplitudes.

In accordance with one aspect of the present invention, a base hue of a desired color is selected. This base hue may be any color, including blue, orange, purple or other colors not commonly found in the outdoors. This base hue may be placed, for example, on a surface of an object, such as painted on a rifle stock or bow, on a person to be camouflaged, such as in makeup applied to a person's face, or on sheet material. If the camouflage system is to be used on sheet material, such as fabric for clothing, the base hue is applied to the fabric, for example, during manufacturing.

In a preferred embodiment of the present invention, the base color is selected to have a reflectance which approximates the reflectivity of the environment in which the object or person to be camouflaged is located. In general, this base color reflectance will be the average of the reflectivity of the environment, taking into account the amount of light available, the areas in shadows, the reflectivity of the background, etc.

In order to provide effective camouflage, it is desirable to include areas of color hues having varying reflectivities in the area containing the base color hue. This breaks up the base color hue into a pattern which is less discernable to an animal. In a preferred embodiment of the present invention, at least three contrast hues of differing reflectivities and of reflectivities that are different from the reflectivity of the base hue are used. These additional contrast hues may either be of the same color as the base hue or a different color. For example, if the background is a red level 6, the contrast hues could be reds or other colors having varying reflectivities selected from the group of reflectivities levels 0–5, and 7–10. If an animal has some color vision, the camouflage system of the present invention is adjusted by using colors less visible to that animal.

FIRST SPECIFIC EXAMPLE

Assume it is desired to produce camouflage cosmetics or paints which can be applied by hunters directly to the exposed areas of their skin or to their equipment. First, a base color is selected which has an average reflectivity approximately equal to the reflectivity of the environment in which the animals are located. For example, if the average reflectivity is equal to 6, a base color hue with a reflectivity of 6 is chosen. In order to make the hunter visible to other hunters, it is desirable to select a color hue which does not typically occur in the environment so that the hunter will readily be noticeable to other hunters, such as orange, purple, red, yellow, etc. If the animals lack color vision, this base color will be perceived by the animal only as a shade of gray with a reflectivity approximately equal to the reflectivity of the environment. The chosen base color is mixed into a base color carrier means, such as a cosmetic or suitable paint for application to the skin of the hunter.

Next, at least three contrast colors with reflectivities different from the reflectivities of the base color and the other contrast colors are selected. The contrast colors may be selected from the same hue as the base color (e.g., all red hues, all orange hues, etc.). Alternately, the contrast colors may be any other colors or mix or colors, depending on the desires of the hunter or in order to make the camouflage system even more visible to other hunters. In the present example, the base color has a reflectivity of 6, so that the contrast colors are chosen to have reflectivities different than 6. For example, contrast colors with reflectivities of 1, 4 and 8 might be selected in order to include a wide range of reflectivities in the system and to break up the base color areas which are reflecting at level 6. Any combination of contrast color reflectivities may be selected. Even fluorescent colors, such as fluorescent lime green with a reflectivity level of 10, can be used as one of the choices. However, contrast colors with reflectivities significantly different from the base color reflectivity and the reflectivities of the other contrast colors are preferred to provide a greater breaking of the area covered by the base color. As above, the contrast colors are each typically contained in a carrier means for application.

SECOND SPECIFIC EXAMPLE

FIG. 4 is an example of a piece of camouflage sheet material in accordance with the system of the present invention. A base color 30 with a reflectivity approximately equal to the reflectivity of the environment has been applied directly to a sheet of flexible material, such as fabric. A plurality of breaking areas, such as areas shaped like palmate leaves 32 are randomly placed on the fabric. The palmate leaf shapes are broken down into smaller, irregularly-shaped areas 34, 36, 38 with stepped edges 40, wherein each of the smaller areas contain one of the contrast colors.

For example, in one embodiment of the present invention, the base color 30 and the contrast colors used in the irregularly-shaped areas can be of the same color hue. If an animal does not see a particular color well, such as animals which do not distinguish reds, oranges and yellows well, the colors can all be the same. Base color 30 could be an orange with a reflectivity approximately equal to the reflectivity of the environment; for example, a medium orange with a reflectivity of 6. The contrast colors could then also be oranges with different reflectivity, such as area 34 could be a dark orange with a reflectivity of 2, area 36 could be a medium dark orange with a reflectivity of 4 and area 38 could be a light orange with a reflectivity of 9.

For animals which lack all color vision, the colors could be selected to maximize the perceptibility of the camouflage to hunters. For example, the base color 30 could be a medium red with a reflectivity of 6. The contrast colors could then be different hues with different reflectivities, such as area 34 could be a dark purple with a reflectivity of 2, area 36 could be a medium turquoise with a reflectivity of 4 and area 38 could be a fluorescent yellow with a reflectivity of 9.

Having described and illustrated the principles of my invention in an illustrative embodiment, it should be apparent to those skilled in the art that the invention can be modified in detail and arrangement without departing from such principles.

Accordingly, I claim as my invention all modifications as may come within the scope and spirit of the following claims and equivalents thereof:

1. A camouflage material for visually concealing people and objects from animals, comprising:

a flexible base sheet;

a base hue of a desired color applied to a portion of the base sheet, wherein the base hue has a first reflectivity and wherein the desired color is other than brown, black and white; and at least three contrast hues of the desired color applied to a portion of the material, each contrast hue having a reflectivity substantially different from the first reflectivity and from the reflectivities of the other contrast hues.

2. The camouflage material of claim 1 wherein the desired color is a bright color.

3. The camouflage material of claim 1 wherein at least one of the contrast hues of the desired color is a fluorescent color.

4. The camouflage material of claim 1 wherein the reflectivity of the base hue is substantially equal to a reflectivity of an environment in which an animal is located.

5. The camouflage material of claim 1 wherein the contrast colors are arranged to resemble a plurality of tree leaves.

6. The camouflage system of claim 5 wherein each tree leaf comprises:

a leaf-shaped outline; and a plurality of irregularly-shaped areas with stepped edges within the leaf-shaped outline, wherein at least certain of the irregularly-shaped areas includes one of the base hue and contrast hues.

7. A camouflage material for visually concealing people and objects from animals, comprising:

a flexible base sheet;

a base color hue having a first reflectivity applied to at least a portion of the base sheet; and at least three contrast color hues located on the material, each contrast color hue having a reflectivity substantially different from the reflectivity of the base color hue and the other contrast color hues, and wherein at least one of the base and contrast color hues are other than brown, black and white.

8. The camouflage material of claim 7 wherein at least one of the base and contrast color hues is a bright color.

9. The camouflage material of claim 7 wherein at least one of the base and contrast color hues is a fluorescent color.

10. The camouflage material of claim 7 wherein the reflectivity of the base color hue is substantially equal to the reflectivity of an environment in which an animal is located.

11. The camouflage material of claim 7 wherein the contrast color hues are arranged to resemble a plurality of tree leaves.

12. The camouflage system of claim 11 wherein each tree leaf comprises:

a leaf-shaped outline; and a plurality of irregularly-shaped areas with stepped edges within the leaf-shaped outline wherein each irregularly-shaped area is randomly supplied with one of the base color hue and contrast color hues.

13. A camouflage system for visually concealing people and objects from animals, comprising:

base color carrier means adapted for application to people and objects, wherein the base color carrier means is of a base color hue having a first reflectivity; and at least three contrast color carrier means adapted for application to people and objects, wherein the contrast color carrier means are each of a contrast color hue having a reflectivity substantially different from the reflectivity of the base color hue and the other contrast color hues and wherein at least one of the base color hue and the contrast color hues is other than brown, black and white.

14. The camouflage system of claim 13 wherein the base and contrast color carrier means is a cosmetic or paint.

15. The camouflage system of claim 13 wherein the base and the contrast color carrier means is a fabric sheet.

16. The camouflage system of claim 13 wherein at least one of the base color carrier means and the contrast color carrier means is a bright color.

17. The camouflage system of claim 13 wherein at least one of the base color carrier means and the contrast color carrier means is a bright color.

18. The camouflage system of claim 13 wherein the reflectivity of the base color carrier means is substantially equal to a reflectivity of an environment in which an animal is located.

19. A method for making camouflage adapted to visually conceal people and objects from an animal, comprising the steps of:

determining in a neutral value system an average level of reflectivity of an environment in which an animal is located;

selecting a base color hue with substantially the same level of reflectivity in the neutral value system as the environment;

selecting at least three contrast color hues with degrees of reflectivity in the neutral value system different from the reflectivity of the base color hue and the other contrast color hues; and applying the base and contrast color hues to a substrate wherein the base and contrast color hues are arranged in a random manner and wherein at least one of the base and contrast color hues are other than brown, black and white.

20. The method of claim 19 wherein at least one of the base hue and contrast color hues are selected from a group of colors highly visible to people but relatively imperceptible to the animal.

21. A camouflage material for visually concealing people and objects from animals, comprising:

a flexible sheet of material having a first hue of a desired color with a first reflectivity applied thereto; and a plurality of leaf shapes of a second hue of the desired color with a second reflectivity randomly arranged on the material, wherein each leaf shape contains a plurality of irregularly-shaped areas each of one of at least three contrast hues of the desired color having differing reflectivities and wherein the irregularly-shaped areas have stepped edges.

* * * * *